US007777123B2

(12) United States Patent
Hennig et al.

(10) Patent No.: US 7,777,123 B2
(45) Date of Patent: Aug. 17, 2010

(54) METHOD AND DEVICE FOR HUMANIZING MUSICAL SEQUENCES

(75) Inventors: Holger Hennig, Göttingen (DE); Ragnar Fleischmann, Göttingen (DE); Fabian Theis, Göttingen (DE); Theo Geisel, Göttingen (DE)

(73) Assignee: Max-Planck-Gesellschaft zur Förderung der Wissenschaften e.V., München (DE)

( * ) Notice: Subject to any disclaimer, the term of this patent is extended or adjusted under 35 U.S.C. 154(b) by 0 days.

(21) Appl. No.: 12/236,708

(22) Filed: Sep. 24, 2008

(65) Prior Publication Data

US 2009/0084250 A1 Apr. 2, 2009

Related U.S. Application Data

(60) Provisional application No. 60/960,410, filed on Sep. 28, 2007.

(51) Int. Cl.
*G10H 7/00* (2006.01)

(52) U.S. Cl. ..... 84/609; 84/612; 84/636; 84/649; 84/652

(58) Field of Classification Search ..... 84/609, 84/612, 636, 649, 652, 645
See application file for complete search history.

(56) References Cited

U.S. PATENT DOCUMENTS 3,974,729 A 8/1976 Koike
5,357,048 A * 10/1994 Sgroi ..... 84/645
6,066,793 A 5/2000 Ogai et al.
6,506,969 B1 1/2003 Baron
7,342,166 B2 * 3/2008 Kay ..... 84/609
2007/0074620 A1 * 4/2007 Kay ..... 84/619
2008/0156178 A1 * 7/2008 Georges et al. ..... 84/645
2009/0084250 A1 * 4/2009 Hennig et al. ..... 84/609

OTHER PUBLICATIONS

Bello et al., A Tutorial on Onset Detection in Music Signals, IEEE Transactions on Speech and Audio Processing, vol. 13, No. 5, Sep. 2005.
Hennig, H. Section 4.2, "Long-range Correlations in Music Rhythms," from "Scale-free Fluctuations in Bose-Einstein Condensates, Quantum Dots and Music Rhythms," Doctoral Dissertation, Georg-August-Universität Göttingen, 2009 [unpublished] [19 pgs.].
Search Report in European Patent Appln. 07117541.8-2225, Jan. 21, 2008 [5 pgs.].

* cited by examiner

*Primary Examiner*—David S. Warren
(74) *Attorney, Agent, or Firm*—Davidson Berquist Jackson & Gowdey, LLP; Brian Siritzky

(57) ABSTRACT

A method for humanizing a music sequence (S), the music sequence (S) comprising a multitude of sounds ($s_1, \ldots, s_n$) occurring on times ($t_1, \ldots, t_n$) comprises the steps generating, for each time ($t_i$) a random offset ($o_i$), adding the random offset ($o_i$) to the time ($t_i$) in order to obtain a modified time ($t_i+o_i$); and outputting a humanized music sequence (S') wherein each sound ($s_i$) occurs on the modified time ($t_i+o_i$).

According to the invention, the power spectral density of the random offsets has the form $$\frac{1}{f^{\alpha}},$$

wherein $0<\alpha<2$.

20 Claims, 5 Drawing Sheets

500

METHOD AND DEVICE FOR HUMANIZING MUSICAL SEQUENCES

This application is related to and claims priority from U.S. Provisional Patent Application No. 60/960,410, titled "Method and device for humanizing musical sequences," filed Sep. 28, 2007, the entire contents of which are incorporated herein for all purposes.

The present invention relates to a method and a device for humanizing music sequences. In particular, it relates to humanizing drum sequences.

TECHNICAL BACKGROUND AND PRIOR ART

Large parts of existing music are characterized by a sequence of stressed and unstressed beats (often called "strong" and "weak"). Beats divide the time axis of a piece of music or a musical sequence by impulses or pulses. The beat is intimately tied to the meter (metre) of the music as it designates that level of the meter (metre) that is particularly important, e.g. for the perceived tempo of the music.

A well-known instrument for determining the beat of a musical sequence is a metronome. A metronome is any device that produces a regulated audible and/or visual pulse, usually used to establish a steady beat, or tempo, measured in beats-per-minute (BPM) for the performance of musical compositions. Ideally, the pulses are equidistant.

However, humans performing music will never exactly match the beat given by a metronome. Instead, music performed by humans will always exhibit a certain amount of fluctuations compared with the steady beat of a metronome. Machine-generated music on the other hand, such as an artificial drum sequence, has no difficulty in always keeping the exact beat, as synthesizers and computers are equipped with ultra precise clocking mechanisms.

But machine-generated music, an artificial drum sequence in particular, is often recognizable just for this perfection and frequently devalued by audiences due to a perceived lack of human touch. The same holds true for music performed by humans which is recorded and then undergoes some kind of analogue or digital editing. Post-processing is a standard procedure in contemporary music production, e.g. for the purpose of enhancing human performed music having shortcomings due to a lack of performing skills or inadequate instruments, etc. Here also, even music originally performed by humans may acquire an undesired artificial touch.

Therefore, there exists a desire to generate or modify music on a machine that sounds more natural.

SUMMARY OF THE INVENTION

It is therefore an object of the present invention to provide a method and a device for generating or modifying music sequences having a more human touch.

This object is achieved according to the invention of by a method and a device according to the independent claims. Advantageous embodiments are defined in the dependent claims.

The term sound to which the claims refer is defined herein as a subsequence of a music sequence. In some embodiments, a sound may correspond to a note or a beat played by an instrument. In other embodiments, it may be a sound sample and more particularly a loop, i.e. a sample of music for continuous repetition. Each sound has a temporal occurrence t within the music sequence.

Preliminary results of empirical experiments carried out by the inventors strongly indicate that a rhythm comprising a natural random fluctuation as generated according to the invention sounds much better or more natural to people than the same rhythm comprising a fluctuation due to Gaussian or uniformly distributed white noise with the same standard deviation, even when using Gaussian instead of uniform white noise.

BRIEF DESCRIPTION OF THE FIGURES

These and further aspect and advantages of the present invention will become more apparent when studying the following detailed description of the invention, in connection with the attached drawing in which.

DETAILED DESCRIPTION OF THE INVENTION

Figure 1:
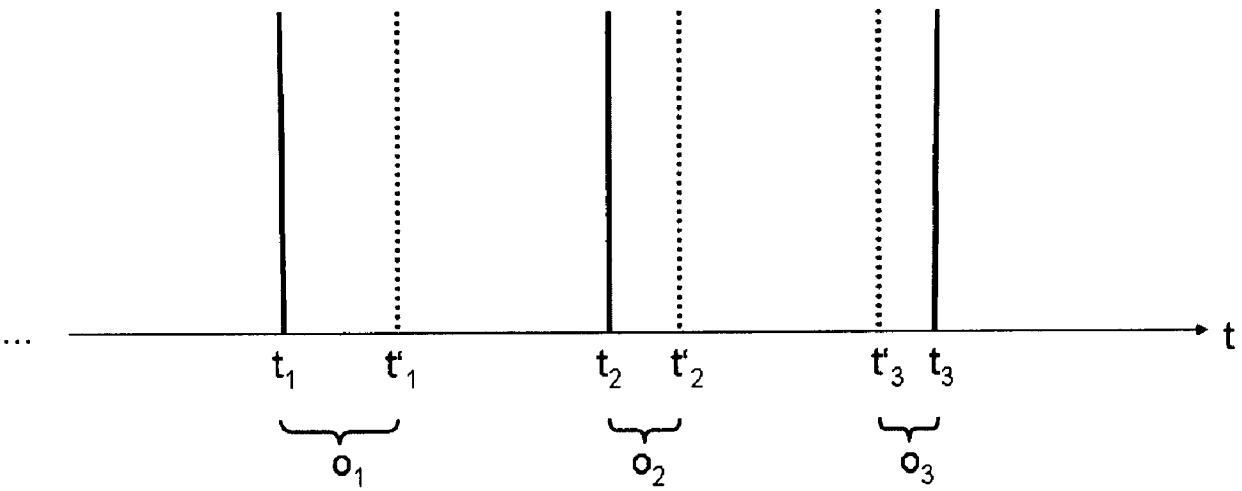
FIG. 1 shows a plot of a natural drum signal or beat compared with a metronome signal.

FIG. 1 shows a plot of a natural drum signal or beat compared with a metronome signal. Compared to a real audio signal, the plot is stylized for the purpose of describing the present invention, which only pertains to the temporal occurrence patterns of sounds. The skilled person will immediately recognize that in reality, each beat or note played is composed of an onset, an attack and a decay phase from which the present description abstracts.

The beats or clicks of the metronome occur on times $t_1$, $t_2$ and $t_3$ and constitute a regular sequence of the form $$t_n = t_0 + nT, \tag{1}$$

wherein $t_n$ is the temporal occurrence or time of the n-th beat, $t_0$ is the time of the initial beat and T denotes the time between metronome clicks.

The human drummer's beats occur on times $t'_1$, $t'_2$ and $t'_3$ and constitute an irregular sequence. The offsets $o_i$ between the beats may be calculated as $$o_n = t_n - t'_n. \tag{2}$$

Alternatively, the above definitions may also be generalized in order to track deviations of a sequence from a given metric pattern instead from a metronome. In other words, instead of taking regular distances T for the metronome clicks, a more complex metronome signal can be generated wherein distances between clicks are not equal but are distributed according to a more complex pattern. In particular, the pattern may correspond to a particular rhythm.

Now, according to empirical investigations of the inventors, the offsets of human drum sequences may be described by Gaussian distributed $1/f^{\alpha}$ noise, where f is a frequency and $\alpha$ is a shape parameter of the spectrum.

Figure 2:
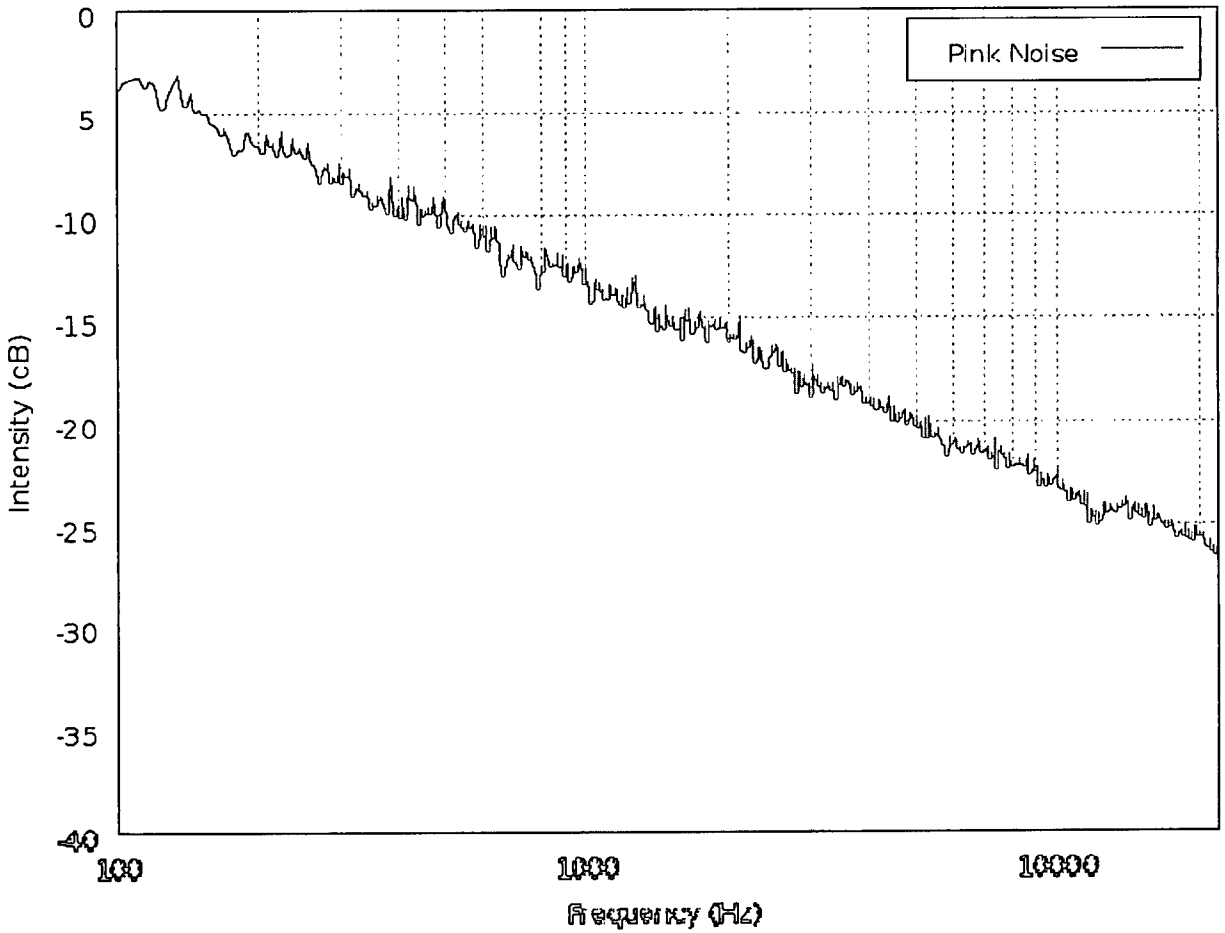
FIG. 2 shows the spectrum of pink noise graphed double logarithmically.

FIG. 2 shows an example of a random signal whose power spectral density is equal to $1/f^{\alpha}$, wherein $\alpha=1$, graphed double logarithmically. Within the scientific literature, this kind of noise is also referred to as 'pink noise'. The parameter $\alpha$ is then equivalent to the absolute value of the slope of the graph.

With regard to the invention, in particular with respect to human drumming, the parameter $\alpha$ may be estimated empirically by comparing the beat sequence generated by a human drum player (or several of them) with a metronome. More particularly, the temporal differences between the human and the artificial beats correspond to the offsets $o_i$ of FIG. 1 and the estimation of $\alpha$ may be carried out by performing a linear regression on the offsets' power spectral frequency plot, wherein the frequency axis has been transformed by two logarithmic transformations for linearization.

Experiments carried out by the inventors using own recordings of the inventors as well as recordings of drummers provided by professional recording studios revealed that the exponent $\alpha$ appears to be widely independent of the drummer. The parameter $\alpha$ also clearly appears to be greater than zero (0). Also, it appears to be smaller than 2.0 in general. For drumming, it has been determined as being smaller than 1.5 in general. However, the offsets of different human drummers may differ in standard deviation and mean.

For the empirical analysis, drums have been chosen because in the analysis, the distinction between accentuation and errors is easiest when analyzing sequences that contain time-periodic structures, such as drum sequences. However, in principle, the methods according to the invention may also be applied to other instruments played by humans. For example, for a piano player playing a song on the piano, it is expectable that after removal of accentuation, the relevant noise obeys the same $1/f^{\alpha}$-law as discussed above with respect to drums.

Based on these empirically determined facts and figures, a method and a device for humanizing music, in particular drum sequences may now be described as follows.

Figure 3:
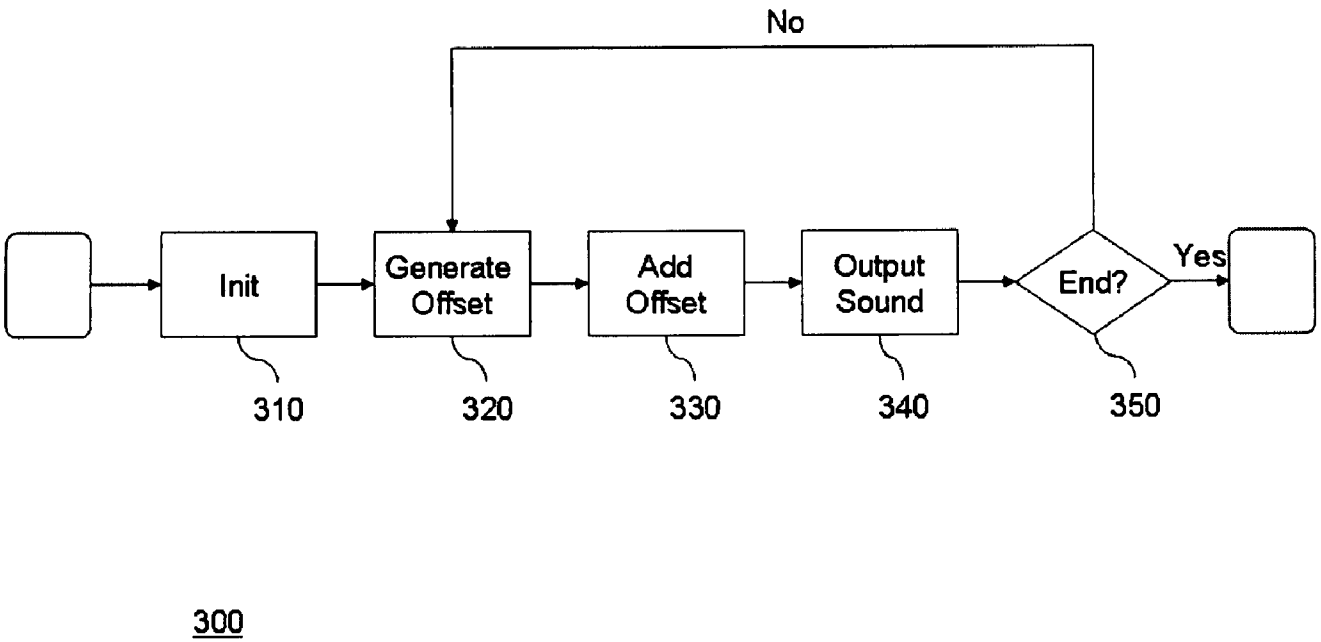
FIG. 3 shows a flowchart of a method according to an embodiment of the invention.

FIG. 3 shows a flowchart of a method for humanizing music sequences according to a first embodiment of the invention. The music sequence may either be computer generated, in particular by using software instruments or loops, or may be recorded natural music or a mix of both. The music sequence is assumed to comprise a series of sounds. The sounds may be recorded notes from an instrument, such as a drum, or may be metronome clicks or music samples e.g. from a software instrument, each sound occurring on a distinct time t, which may e.g. be the beginning of a music sample. When humanizing real audio signals comprising notes played by instruments, the time t may be taken as the onset of a note, which may automatically be detected by a method in the prior art (cf. e.g. Bello et al., A Tutorial on Onset Detection In Music Signals, IEEE Transactions on Speech and Audio Processing, Vol. 13, No. 5, September 2005, fully incorporated by reference into the present application).

In step 310, the method is initialized. In particular, the algorithm may be set to the first time $t_0$ (i=0).

In step 320, a random offset $o_i$ is generated for the present sound or note at time $t_i$.

In step 330, the random offset $o_i$ is added to the time $t_i$ in order to obtain a modified time $t'_i$. Hereby, it is understood that the offset $o_i$ may also be negative.

In step 340, the present sound $s_i$ is output at the modified time $t'_i$. The outputting step may comprise playing the sound in an audio device. It may also comprise storing the sound on a medium, at the modified time $t'_1$ for later playing.

In step 350, the procedure loops back to step 320 in order to repeat the procedure for the remaining sounds.

According to the invention, the random offsets are generated such that their power spectral density obeys the law $$\frac{1}{f^{\alpha}}.$$

wherein $\alpha>0$.

The parameter $\alpha$ may be set according to the empirical estimates obtained as described in relation to FIG. 2.

Figure 4:
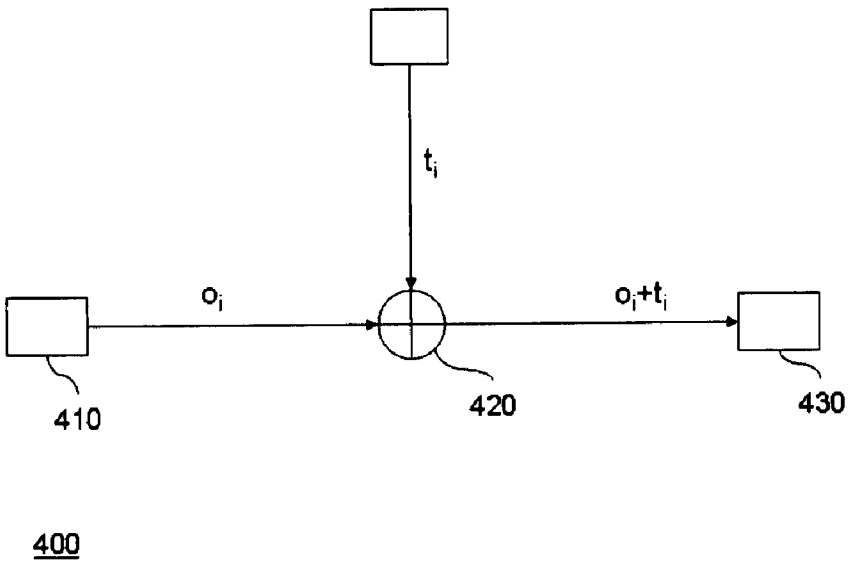
FIG. 4 shows a block diagram of a device for humanizing music sequences according to an embodiment of the invention.

FIG. 4 shows a block diagram of a device 400 for humanizing a music sequence according to an embodiment of the invention.

Again, it is assumed that the music sequence (S) comprises a multitude of sounds ($s_1 \ldots s_n$) occurring on times ($t_1, \ldots, t_n$). According to one embodiment of the invention, the device may comprise means 410 for generating, for each time ($t_i$) a random offset ($o_i$).

The device may further comprise means 420 for adding the random offset ($o_i$) to the time ($t_i$) in order to obtain a modified time ($t_i+o_i$).

Finally, the device may also comprise means 430 for outputting a humanized music sequence (S') wherein each sound ($s_i$) occurs on the modified time ($t_i+o_i$). The humanized music sequence (S') may be output, e.g. stored to a machine-readable medium, such as a CD (compact disc) or DVD or output to an equalizer, amplifier and/or loudspeaker.

According to the invention, the power spectral density of the random offsets has the form $$\frac{1}{f^{\alpha}},$$

wherein $0<\alpha<2$. Generators for $1/f^{\alpha}$- or colored noise (for f=2 also called 'pink' noise) are commercially available.

Figure 5:
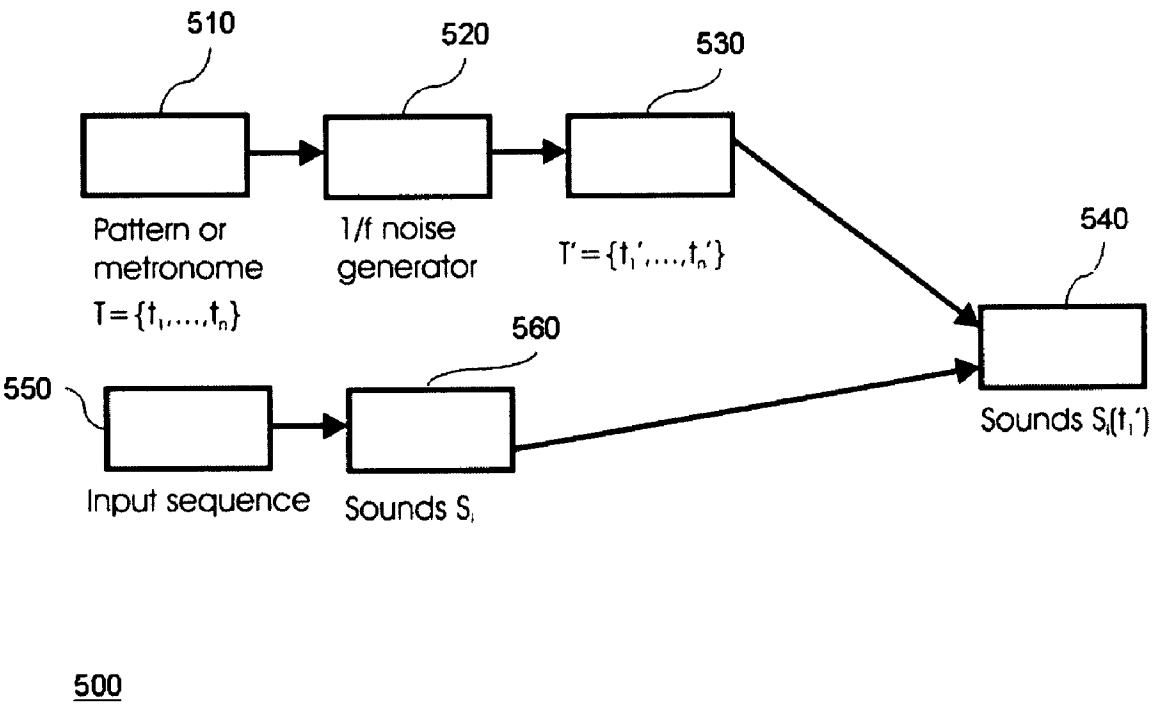
FIG. 5 shows another block diagram of a device for humanizing music sequences according to another embodiment of the invention.

FIG. 5 shows another block diagram of a device for humanizing music sequences according to another embodiment of the invention. The device comprises a metronome 510, a noise generator 520, a module 530 for adding the random offsets to obtain a modified time sequence, a module 540 for outputting the sounds at the modified times, a module 550 for receiving an input sequence and a module 560 for analyzing the input sequence in order to automatically identify the relevant sounds.

SUMMARY

The deviation of human drum sequences from a given metronome may be well described by Gaussian distributed $1/f^{\alpha}$ noise, wherein the exponent $\alpha$ is distinct from 0. In principle, the results do also apply to other instruments played by humans. In conclusion, the method and device for humanizing musical sequence may very well be applied in the field of electronic music as well as for post processing real recordings. In other words, $1/f^{\alpha}$-noise is the natural choice for humanizing a given music sequence.

We claim:

1. A computer-implemented method for humanizing a music sequence (S), the music sequence (S) comprising a multitude of sounds ($s_1, \ldots, s_n$) occurring on times ($t_1, \ldots, t_n$), the method comprising the steps of, by hardware in combination with software:

generating, for each time ($t_i$) a random offset ($o_i$), adding the random offset ($o_i$) to the time ($t_i$) in order to obtain a modified time ($t_i+o_i$); and outputting a humanized music sequence (S') wherein each sound ($s_i$) occurs on the modified time ($t_i$+$o_i$), characterized in that the power spectral density of the sequence of random offsets has the form:

$$\frac{1}{f^{\alpha}}$$

wherein f is a frequency, α is a shape parameter of the spectrum and 0<α<2.

2. A method according to claim 1, wherein the sounds correspond to drum beats.

3. A method according to claim 1, wherein the sounds correspond to notes played by a piano.

4. A method according to claim 1, wherein the music sequence (S) is obtained from editing a human-generated music sequence.

5. A method according to claim 1, wherein the mean and/or the standard deviation of the offsets ($o_i$) is set according to empirical estimates.

6. A method according to claim 1, wherein the sequence of sounds is generated by using electronic music loops.

7. A method according to claim 1, wherein outputting a humanized music sequence (S') comprises storing the music sequence (S') on a machine-readable medium.

8. Computer-generated music sequence (S), comprising a multitude of sounds ($s_1, \ldots, s_n$) occurring on times ($t'_1, \ldots, t'_n$), wherein the times are offset with offsets ($o_1, \ldots, o_n$) against the clicks ($c_1, \ldots, c_n$) of a metronome, wherein the power spectral density of the sequence of offsets ($o_1, \ldots, o_n$) has the form:

$$\frac{1}{f^{\alpha}}$$

wherein f is a frequency, α is a shape parameter of the spectrum, and 0<α<2.

9. A Computer-generated music sequence according to claim 8, wherein the music sequence (S) is obtained from editing a human-generated music sequence.

10. A Computer-generated music sequence according to claim 8, wherein the mean and/or the standard deviation of the offsets ($o_i$) is set according to empirical estimates.

11. A Computer-generated music sequence according to claim 8, wherein the sequence of sounds is generated by using electronic music loops.

12. A Computer-generated music sequence according to claim 8, wherein the sounds correspond to at least one of drum beats and notes played by a piano.

13. Machine readable medium, comprising a computer-generated music sequence according to claim 8.

14. A device for humanizing a music sequence (S), the music sequence (S) comprising a multitude of sounds ($s_1, \ldots, s_n$) occurring on times ($t_1, \ldots, t_n$), the device comprising:

a generator constructed and adapted to generate, for each time ($t_i$) a random offset ($o_i$), an adder, constructed and adapted to add the random offset ($o_i$) to the time ($t_i$) in order to obtain a modified time ($t_i$+$o_i$); and an output mechanism constructed and adapted to output a humanized music sequence (S') wherein each sound ($s_i$) occurs on the modified time ($t_i$+$o_i$), characterized in that the power spectral density of the random offsets has the form $$\frac{1}{f^{\alpha}}$$

wherein f is a frequency, α is a shape parameter of the spectrum, and 0<α<2.

15. A device according to claim 14, wherein the generator comprises means for generating for each time ($t_i$) a random offset ($o_i$).

16. A device according to claim 14, wherein the adder comprises means for adding the random offset ($o_i$) to the time ($t_i$) in order to obtain a modified time ($t_i$+$o_i$).

17. A device according to claim 14, wherein the output mechanism comprises means for outputting the humanized music sequence (S').

18. A device according to claim 14, wherein the mean and/or the standard deviation of the offsets ($o_i$) is set according to empirical estimates.

19. A device according to claim 14, wherein the sequence of sounds is generated by using electronic music loops.

20. A device according to claim 14, wherein outputting a humanized music sequence (S') comprises storing the music sequence (S') on a machine-readable medium.

* * * * *